United States Patent [19]

Sowle

[11] 3,967,848

[45] July 6, 1976

[54] FOLDING HANDLE FOR CUPS, CANS AND OTHER USES

[76] Inventor: Niles M. Sowle, 1156 Herbert J, Jackson, Mich. 49202

[22] Filed: June 7, 1973

[21] Appl. No.: 367,964

[52] U.S. Cl. ..... 294/31.2; 215/100 A; 220/94 R; 224/45 C; 229/1.5 H

[51] Int. Cl.[2] ..... A47J 45/06; B65D 25/28

[58] Field of Search ..... 294/27 R, 27 H, 28, 294/31 A, 31.2, 32; 220/94 R, 96, 85 H; 215/100 A; 224/45 A, 45 AB, 45 C, 45 H; 222/465; 229/1.5 H

[56] References Cited

UNITED STATES PATENTS

| | | | |
|---|---|---|---|
| 890,354 | 6/1908 | Giard | 294/32 X |
| 1,693,772 | 12/1928 | Allen | 294/27 H |
| 3,482,867 | 12/1969 | Allen | 294/31.2 X |

*Primary Examiner*—Evon C. Blunk
*Assistant Examiner*—James L. Rowland
*Attorney, Agent, or Firm*—Dale Austin Winnie

[57] ABSTRACT

A U-shaped strap providing a frame with upturned ends and having an annular ring pivotally engaged at diametrically opposite sides to the upturned ends, one of which also serves as a handle loop, and with the annular ring disposed transversely to receive a cup therewithin or disposed in relative alignment with the frame strap for non-use and storage. And with further improvements allowing more compact folding and a smaller collapsed size thereof.

4 Claims, 8 Drawing Figures

FOLDING HANDLE FOR CUPS, CANS AND OTHER USES

BACKGROUND OF THE INVENTION

Although cup holders and the like, for various beverage containers, are generally known — both to provide a holder which avoids direct hand contact with hot or overly cold containers and to provide a handle for such containers as do not otherwise include one — they are seldom if ever collapsible to the extent, at least, that they will lie relatively flat for simple and convenient storage when not in use.

The need for such a holder or handle serving device is particularly obvious as regards hot beverages dispensed in cups by vending machines in office, factory locations, and elsewhere. Such cups may include folding handle parts, made as part of the cup, but they are far from stable or adequate and direct contact with the hot beverage container is still usually necessary and, as a consequence, they are infrequently used.

For hot soups and the like there is seldom any carrying device, beyond the container itself.

What is needed is a relatively simple and therefor inexpensive folding handle device of some type which is collapsible to fold flat, when not in use, and is sufficiently light in weight and compact to be carried in a shirt or trouser pocket, or a woman's purse and, conceivably, might even be of such relative size and low cost as to be capable of being dispensed, itself, from a vending machine and to be a relatively disposable item, in some instances.

At the same time, it must obviously be capable of providing good stable support and a carrying handle for its intended purpose when in use.

SUMMARY OF THE PRESENT INVENTION

This invention is directed to a folding handle device to serve the purposes aforementioned.

It includes a U-shaped strap which serves as an underframe and has an annular ring provided on its upturned ends through which a beverage container may be disposed to rest on the underlying frame strap. And it has a handle loop on one of the frame strap ends for carrying purposes.

More importantly, the annular ring is pivotally engaged at diametrically opposite sides to the upturned ends of the frame strap so that it may be turned into relative alignment and lie flat with the U-shaped strap, when not in use.

In another variation, the annular ring is made in two semi-annular halves so that they may also be folded together, one relatively within the other, and the handle loop is made pivotal so that it may be folded in from its outwardly disposed position for use to one over and within the annular ring halves as collapsed together.

These and other advantageous features will be more fully described and appreciated in the detailed description which follows of the two preferred embodiments of the invention shown by the accompanying drawing figures.

DESCRIPTION OF THE DRAWING FIGURES

DETAILED DESCRIPTION OF ILLUSTRATED EMBODIMENTS

Figure 1:
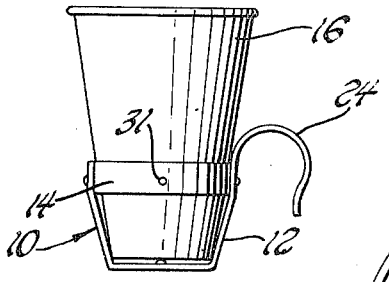
FIG. 1 is a side plan view of a hot beverage cup in a folding handle device including the teachings of the present invention.
Figure 2:
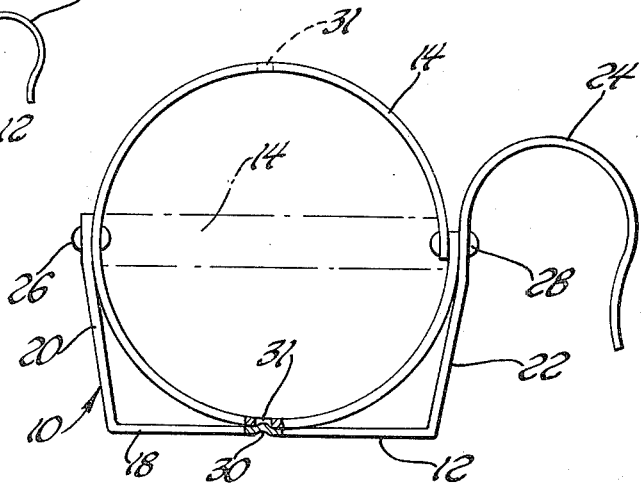
FIG. 2 is an enlarged side plan view of the same folding handle, folded flat, and with the annular ring position, as disposed for use, shown in phantom lines.

The folding handle arrangement 10, shown in FIGS. 1 and 2, includes a U-shaped strap 12 which serves as an under frame for an annular ring 14 which is receptive of a beverage container, such as the cup 16.

In this particular instance, both the frame strap and ring members 12 and 14 are made of 20 gage stainless steel. But plastic or other materials could be used equally as well.

The U-shaped strap or frame member 14 includes a bottom portion 18 and relatively spaced upturned ends 20 and 22 which slant out slightly to conform more closely to the truncated end of the cup container it receives. And a handle loop 24 is formed with and as an extended part of the one frame member end 22.

The annular ring 14 is of a relatively like material and width as the frame strap 12 formed from a given length to a circular shape and with its ends just slightly overlapping at one of the pivot or hinge connections. Or, it may be made as one continuous closed band, as a manufacturing alternative if and as desired.

Rivet pin connections 26 and 28 are used at diametrically opposite sides of the annular ring 14 to serve as pivotal connections fastening the ring to the upturned ends 20 and 22 of the frame strap 12 and to allow it to be disposed either transversely, to receive the beverage cup 16, or in relative aligned relation with the frame strap, as shown in the second drawing figure.

Figure 3:
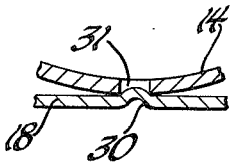
FIG. 3 is a further enlarged cross-sectioned fragmentary detail of the folding handle device shown in the previous two drawing figures.

It will be noted that the upturned ends 20, 22 of the frame strap and the annular ring 14 are so sized and dimensioned. that the ring, as folded into relative alignment with the frame strap, is in frictional engagement with the bottom portion 18 of the frame strap. Because of the relative light gage of the material used and some spring or give in the frame strap, this engagement can be sufficient to hold the ring flat with the under frame part. However, an added feature may include a detent 30 formed in the bottom portion 18 for engagement in pin holes 31, as shown in the detail view of FIG. 3, which may be provided on opposite sides of the annular ring 14 for more assured location and retension.

Figure 4:
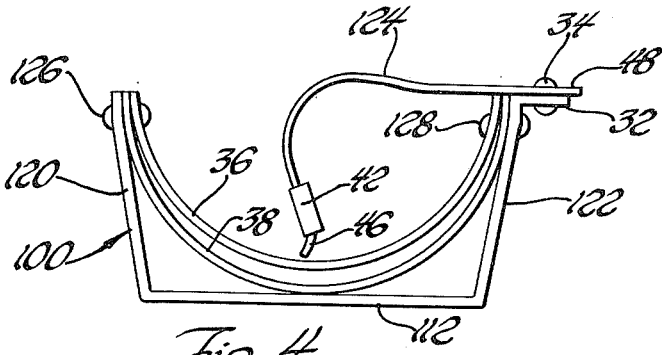
FIG. 4 is a side plan view of another folding handle arrangement, as collapsed and folded together.
Figure 5:
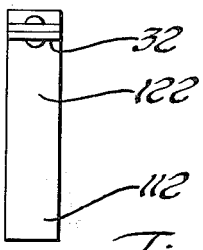
FIG. 5 is an end view, from the handle loop side, of the folding handle device shown in the immediately preceeding drawing figure.
Figure 6:
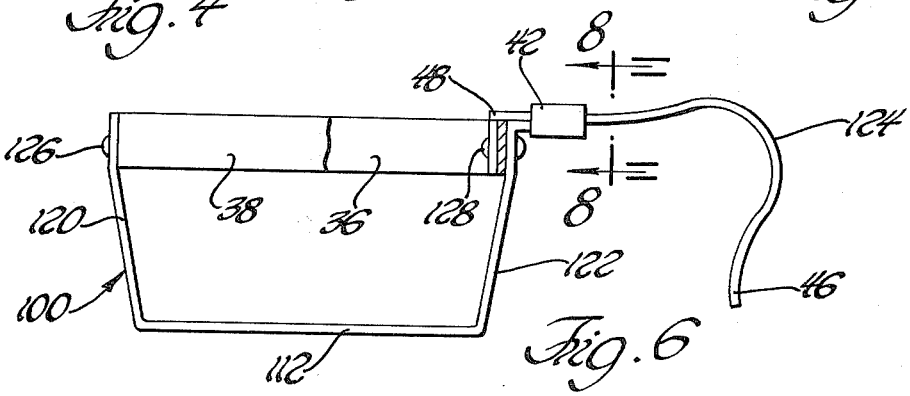
FIG. 6 is of the same folding handle device as erected for use, with part of the annular ring broken away to show a detail feature near the handle loop.

In FIGS. 4–6 there is shown a folding handle arrangement 100 which has other features making it foldable or collapsible into a more compact and smaller size than the one previously described.

It also includes a U-shaped strap 112, which serves as an underframe, and has the like upturned ends 120 and 122 which slant slightly outward. However, the one upturned end 122 has its extreme end bent outwardly, as at 32, and the handle loop 124 is a separate part, in this instance, which is pivotally connected to the frame end 32 as by a rivet pin pivotal connection 34.

The annular ring is formed by two semi-circular or annular parts 36 and 38, rather than as one single ring, and with their respective ends fastened together and to the upturned ends of the frame strap by rivet pin pivotal connections 126 and 128. As will be noted, the two ring parts are so sized and connected that one thereof may be turned and folded within the other and both may be disposed in relative alignment with the frame strap part.

The handle loop 124, being pivotal to turn inward and lie over the two nested ring parts 36 and 38, will also be noted to extend over the two ends of ring halves, as at 40, and, with the ring halves ends square cut, to provide a lock for them holding the parts in their flat nested arrangement.

Figure 7:
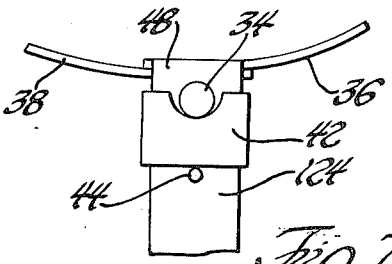
FIGS. 7 and 8 are, respectively, enlarged fragmentary top and cross-sectional end views of the handle loop retaining feature, with the later taken substantially in the plane of line 8—8, in FIG. 6, and looking in the direction of the arrows.
Figure 8:
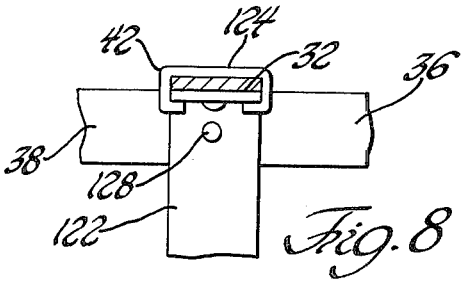

A slide clip 42 is provided on the handle loop 124 to lock the handle loop in its outwardly disposed position, for use, as best shown in FIGS. 6–8. It overlaps the outwardly bent end 32 of the frame part, and holds the handle loop aligned therewith, in its handle locking position, just forward of a retaining detent 44, shown most clearly in FIG. 7.

The extreme end of the handle loop is bent out, as at 46, just enough to prevent the slide clip 42, due to its relative length, from slipping off the end thereof, when not in use. And the handle loop also has its other end extended, as at 48, just sufficiently beyond its pivotal junction to the frame part to overlie the two ring halves 36 and 38, as shown in FIG. 6, to hold them in their erected closed ring disposition for use.

From the foregoing it will be appreciated that the folding handle arrangement 10 is the more simple to manufacture and to use, but that it does not fold to as small and compact a size as the handle arrangement 100.

The second folding handle arrangement 100 has the advantage, as shown in FIG. 4, of allowing the upper ring half (as folded flat) to fold down within the other ring half and of having the handle loop capable of being turned inwardly within and over the two nested ring halves to provide a collapsed or compacted size of about half the height and about one-third the width.

Both folding handle arrangements, however, are simple and inexpensive in construction, may be made of metal or plastic material, may be packaged flat and compacted for distribution and sale, and should prove of such relatively low cost as to have wide acceptance and practical use in numerous instances.

I claim:

1. A folding handle for hand held beverage cups, containers and the like, and comprising; a frame member including a U-shaped strap having a bottom portion and relatively spaced upturned ends, a finger receptive handle loop provided on one of said upturned ends, and an annular ring pivotally engaged at diametrically opposite sides to said upturned ends for being disposed transversely of said frame member for use in receiving a beverage container therewithin and supported on said bottom frame portion and for being disposed in relative alignment with said frame member and in combination therewith being sized for compact storage and ready accessibility within a shirt pocket or the like, said annular ring including semi-annular halves pivotally engaged together and to said upturned frame ends for being relatively brought together and folded one within the other, and said handle loop being pivotally engaged to said one upturned frame end for being relatively turned from an outwardly disposed position to an inwardly disposed position relatively over said semi-annular ring halves as folded together.

2. The folding handle of claim 1, said handle loop including an end thereof overlapping said semi-annular ring and for engagement therewith precluding their being folded together when said handle loop is disposed for use.

3. The folding handle of claim 2, said one upturned end of said U-shaped strap being bent outwardly at its end and having said handle loop pivotally engaged thereto, and a clip member slidable on said handle loop for overlapping engagement with said outwardly bent end and retaining said handle loop in aligned engagement therewith and disposed outwardly for use.

4. A folding handle for use with drinking cups and other hand held beverage containers, and comprising; a ring member sized to receive a hand held beverage container therewithin, another member pivotally engaged to said ring member and formed to include a finger sized handle loop disposed outward on one side of said ring member for beverage container lifting and tilting use, and means for turning said handle loop member from a position within the plane of said ring member to a position for use transversely thereof and including a U-shaped strap having opposite ends pivotally fastened to diametrically opposite sides of said ring member and one of said ends operative of said handle loop member, said U-shaped strap having a bottom portion between its pivotally fastened ends and being sized relative to said ring member for frictional engagement of said bottom portion with said ring member as disposed in the plane thereof and for retention of said U-shaped strap and handle loop member in flat folded relation with said ring member, and said ring member and bottom portion of said U-shaped strap being formed to include a cooperative detent and pin hole for retentive engagement of the one with the other as disposed in flat folded relation.

* * * * *